US011098718B2

(12) United States Patent
North et al.

(10) Patent No.: US 11,098,718 B2
(45) Date of Patent: Aug. 24, 2021

(54) PUMP COOLING SYSTEMS

(71) Applicant: Edwards Limited, Burgess Hill (GB)

(72) Inventors: Michael Henry North, Redhill (GB); Phillip North, Horsham (GB); Malcolm William Gray, Crawley (GB); Neil Turner, Godalming (GB)

(73) Assignee: Edwards Limited, Burgess Hill (GB)

( * ) Notice: Subject to any disclaimer, the term of this patent is extended or adjusted under 35 U.S.C. 154(b) by 196 days.

(21) Appl. No.: 16/483,145

(22) PCT Filed: Dec. 21, 2017

(86) PCT No.: PCT/GB2017/053851
§ 371 (c)(1),
(2) Date: Aug. 2, 2019

(87) PCT Pub. No.: WO2018/142095
PCT Pub. Date: Aug. 9, 2018

(65) Prior Publication Data

US 2020/0240414 A1 Jul. 30, 2020

(30) Foreign Application Priority Data

Feb. 3, 2017 (GB) ..... 1701833
Oct. 5, 2017 (GB) ..... 1716236

(51) Int. Cl.
*F04C 29/04* (2006.01)
*F04C 18/16* (2006.01)
(Continued)

(52) U.S. Cl.
CPC ..... *F04C 29/04* (2013.01); *F04B 39/064* (2013.01); *F04C 15/0096* (2013.01);
(Continued)

(58) Field of Classification Search
CPC ..... F04D 15/0263; F04D 29/58–5893; F04B 53/08; F04B 39/064; F04C 15/0096;
(Continued)

(56) References Cited

U.S. PATENT DOCUMENTS 3,463,224 A * 8/1969 Myers ..... B64G 1/50 165/276
5,875,096 A * 2/1999 Gates ..... H01L 23/433 361/704
(Continued)

FOREIGN PATENT DOCUMENTS

CN 204371607 U 6/2015
DE 102007008594 A1 * 6/2008 ..... A62C 3/16
(Continued)

OTHER PUBLICATIONS

International Search Report and Written Opinion dated Mar. 12, 2018 in counterpart International Application No. PCT/GB2017/053851, 14 pp.
(Continued)

*Primary Examiner* — Laert Dounis
(74) *Attorney, Agent, or Firm* — Shumaker & Sieffert, P.A.

(57) ABSTRACT

A pump cooling system may include a cooling body configured to be fitted to a pump housing to receive heat from the pump housing via a heat conducting path between the cooling body and pump housing. The cooling body may have a passage through which, in use, a cooling fluid is passed to conduct heat away from the cooling body. The pump cooling system includes a cooling control mechanism configured to provide a gap in the heat conducting path at pump operating temperatures below a predefined temperature so heat conduction from the pump housing to the cooling body is interrupted.

20 Claims, 9 Drawing Sheets

(51) Int. Cl.

| | |
|---|---|
| ***F04C 27/00*** | (2006.01) |
| ***F04D 29/58*** | (2006.01) |
| ***F04D 15/02*** | (2006.01) |
| ***F04B 39/06*** | (2006.01) |
| ***F04C 15/00*** | (2006.01) |
| ***F28D 19/04*** | (2006.01) |
| ***F28F 13/00*** | (2006.01) |

(52) U.S. Cl.
CPC ..... *F04C 18/16* (2013.01); *F04C 27/00* (2013.01); *F04D 15/0263* (2013.01); *F04D 29/58* (2013.01); *F04D 29/5893* (2013.01); *F28D 19/04* (2013.01); *F28F 13/00* (2013.01); *F04C 2220/10* (2013.01); *F04C 2240/30* (2013.01); *F28F 2013/008* (2013.01); *F28F 2280/10* (2013.01)

(58) Field of Classification Search
CPC . F04C 29/04; F28F 2013/008; F28F 2013/08; F28F 2280/10; F28F 5/00; F28D 19/04–045
See application file for complete search history.

(56) References Cited

U.S. PATENT DOCUMENTS

| | | | | |
|---|---|---|---|---|
| 10,865,000 | B2 * | 12/2020 | Newlin | B64G 1/50 |
| 2015/0086328 | A1 | 3/2015 | Tsutsui | |
| 2017/0241649 | A1 * | 8/2017 | Cave | F28D 20/0056 |
| 2019/0219339 | A1 * | 7/2019 | Cave | F28D 19/047 |

FOREIGN PATENT DOCUMENTS

| | | | | |
|---|---|---|---|---|
| DE | 102011102138 | A1 * | 11/2012 | F28D 20/0056 |
| DE | 102011112600 | A1 * | 3/2013 | F01N 5/02 |
| EP | 1231383 | A1 | 8/2002 | |
| FR | 2811744 | A1 * | 1/2002 | F24H 7/0408 |
| JP | H048896 | A | 1/1992 | |
| JP | 2009097341 | A | 5/2009 | |
| KR | 20120131461 | A | 12/2012 | |
| TW | M492957 | U | 1/2015 | |

OTHER PUBLICATIONS

Combined Search and Examination Report under Sections 17 and 18(3) dated Jul. 12, 2017 in counterpart GB Application No. 1701833.4, 6 pp.

Translation of the Office Action from counterpart Taiwanese Application No. 107101151, dated Dec. 8, 2020, 3 pp.

* cited by examiner

PUMP COOLING SYSTEMS

This application is a national stage entry under 35 U.S.C. § 371 of International Application No. PCT/GB2017/053851, filed Dec. 21, 2017, which claims the benefit of GB Application 1701833.4, filed Feb. 3, 2017 and GB Application 1716236.3, filed Oct. 5, 2017. The entire contents of International Application No. PCT/GB2017/053851, GB Application 1701833.4, and GB Application 1716236.3 are incorporated herein by reference.

TECHNICAL FIELD

The disclosure relates to pump cooling systems and particularly, but not exclusively, to pump cooling systems associated with screw pumps.

BACKGROUND

It is known to cool pumps, such as vacuum pumps, by fixing cooling plates onto the pump casing. Heat conducted from the casing to the cooling plates is conducted away from the pump by a flow of cooling water passing through passages that extend through the cooling plates. These passages in the cooling plates are prone to calcification. This may be caused by hot operation of the pump when the water flow is turned off, for example by use of a solenoid valve, during which time the stagnant water in the passages will increase in temperature and may actually boil. The water flow may be stopped to control the temperature of the pump or during periods in which pump cooling is not needed.

To minimize calcification, the water supply to the cooling plates may be kept on regardless of the heat output of the pump. However, this may result in overcooling of the pump when the heat output is low when, for example, it is operating at low loads. Overcooling is undesirable as it may, for example, cause condensation of the pumped gases in the pumping mechanism. One way to reduce this problem is to provide a long heat-path to the cooling plates. This may be effective, provided the quantity of heat to be removed remains constant. However, the heat load for most dry vacuum pumps will change depending on the pump inlet pressure.

SUMMARY

The disclosure provides a pump cooling system comprising, a cooling body to be fitted to a pump housing to receive heat from said pump housing via a heat conducting path between said cooling body and pump housing, said cooling body having a passage through which, in use, a cooling fluid is passed to conduct heat away from the cooling body; and a cooling control mechanism configured to provide a gap in said heat conducting path at pump operating temperatures below a predefined temperature whereby heat conduction from said pump housing to said cooling body is interruptible The disclosure also includes a pump comprising, a pump housing and a pumping mechanism disposed in said pump housing; and a pump cooling system comprising a cooling body and a cooling control mechanism, wherein said cooling body is to receive heat from said pump housing via a heat conducting path and is provided with a passage through which, in use, a cooling fluid is passed to conduct heat away from said cooling body, and said cooling control mechanism is configured to provide a gap in said heat conducting path between said pump housing and said cooling body at pump operating temperatures below a predefined temperature, whereby heat conduction from said pump housing to said cooling body is interruptible.

The disclosure also includes a method of providing pump cooling comprising the steps of providing a cooling body to receive heat from the pump by heat conduction, said cooling body having a passage through which cooling fluid is passed to convey heat away from said cooling body; providing a cooling control mechanism configured to provide a gap in a heat conducting path between said pump and said cooling body when pump operating temperatures are below a predefined temperature whereby heat conduction between said pump and cooling body is controllably interruptible.

BRIEF DESCRIPTION OF THE DRAWINGS

In the following disclosure, reference will be made to the drawings.

DETAILED DESCRIPTION

Figure 1:
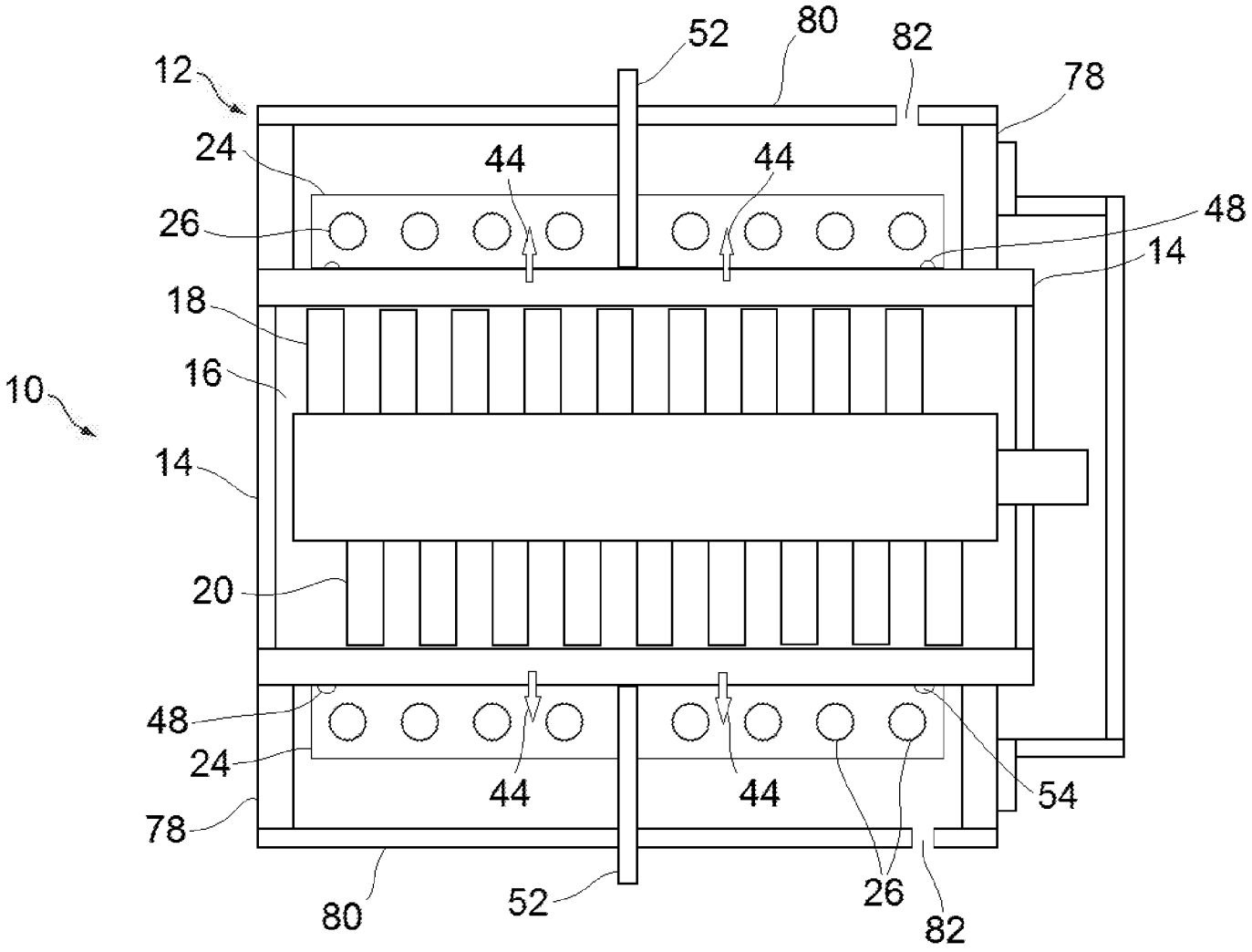
FIG. 1 is schematic illustration of a pump having a pump cooling system showing the pump cooling system in cooling mode.

FIG. 1 shows a pump 10 provided with a pump cooling system 12. In this example the pump is a screw pump 10. The screw pump 10 comprises a pump housing, or casing, 14. The pump housing 14 may comprise an assembly of housing members that define a pumping chamber 16. A pair of meshing screw rotors 18, 20 is housed in the pumping chamber 16. The screw rotors 18, 20 are driven by, for example an electric motor (not shown) to cause a fluid to be pumped from a pump inlet to a pump outlet (not shown). The screw pump 10 may be a dry pump that has no lubricant supply to the screw rotors 18, 20.

The pump cooling system 12 comprises at least one cooling body 24. In some examples, there will be plurality of cooling bodies 24 disposed about the pump housing 14.

Figure 2:
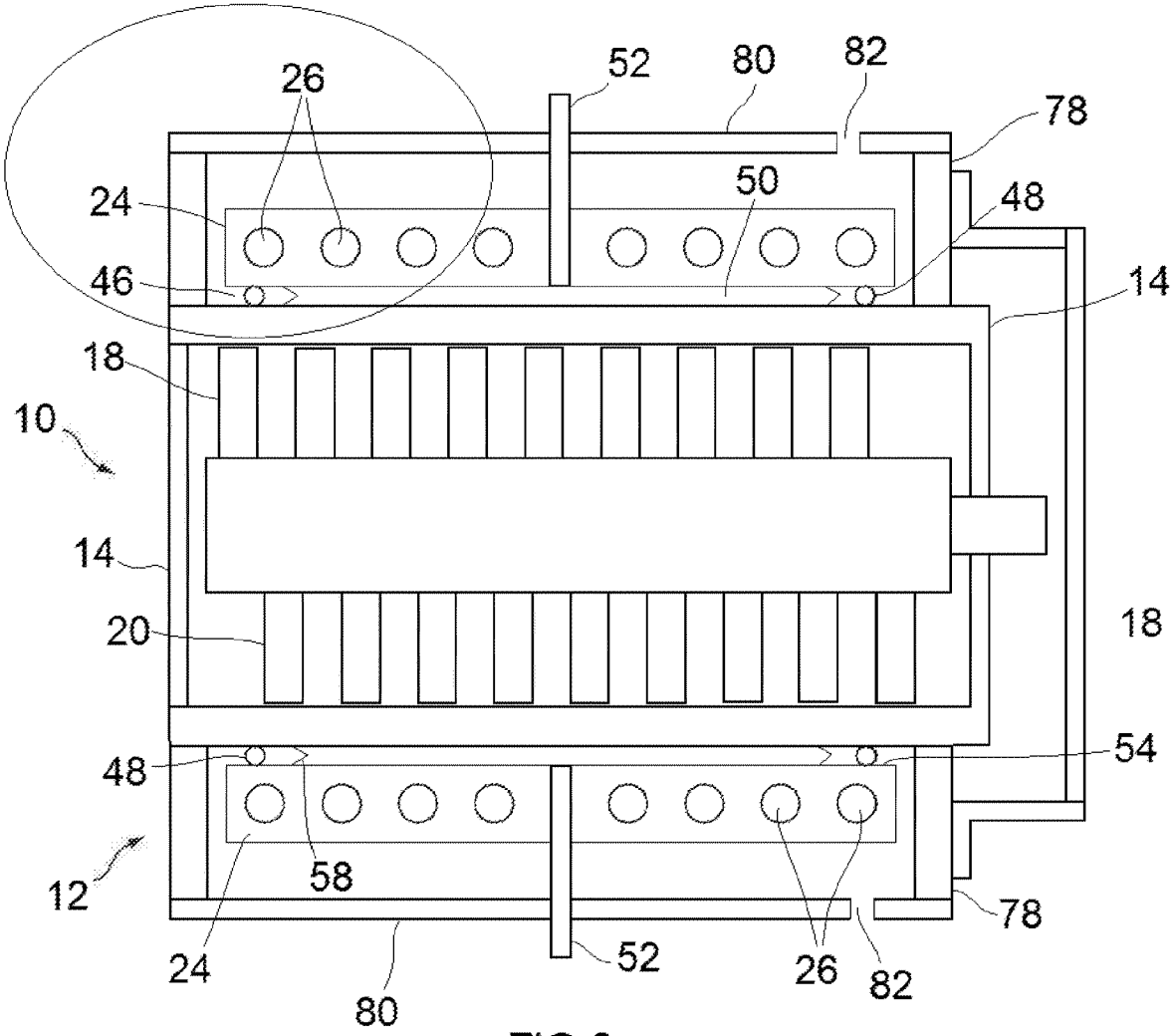
FIG. 2 is a view corresponding to FIG. 1 showing the pump cooling system in non-cooling mode.

By way of example, FIGS. 1 and 2 show two such cooling bodies 24. The cooling bodies 24 each have at least one through-passage 26 through which, in use, a cooling fluid is passed to conduct heat away from the cooling body. The, or each, through-passage 26 may be cast into the cooling body 24. In some examples, the cooling body 24 may comprise multiple bodies secured in face to face relation with at least one face provided with recessing to define the, or a plurality of, through-passages.

Figure 3:
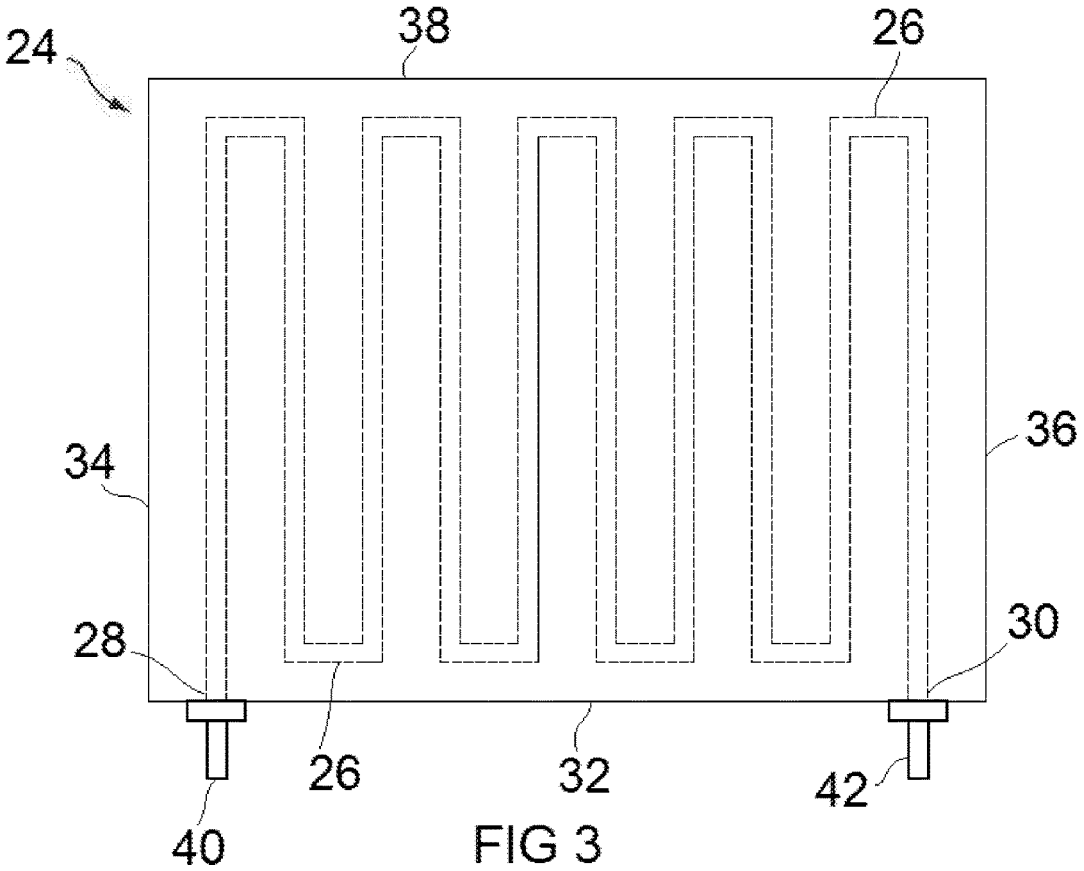
FIG. 3 is a schematic plan view of a cooling body of the pump cooling system.

As shown in FIG. 3, a cooling body 24 may have just one such through-passage 26 and that may follow a convoluted path between an inlet end 28 and an outlet end 30. The inlet and outlet ends 28, 30 of the through-passage 26 may be disposed at one end 32 and at opposite sides 34, 36 of the cooling body 24. In other examples, the inlet and outlet ends 28, 30 may be disposed adjacent opposite ends 32, 38 of the cooling body and in such examples, the inlet and outlet ends may be disposed at the same or opposite sides 34, 36 of the cooling body 24. The inlet and outlet ends 28, 30 of the through-passage 26 may be provided with respective fittings, or couplings, 40, 42 by which the through-passage 26 may be connected with piping through which the cooling fluid is supplied to and conducted away from the through-passage. The fittings 40, 42 may take any convenient form and may, for example, comprise male hose tail connectors screwed into threading provided in the inlet and outlet ends 28, 30 of the through-passage 26 and onto which plastics piping can be push-fitted. In the example shown in FIG. 3, there is just one through-passage 26. However, in other examples, there may be a plurality of separate through-passages that each have an inlet end and an outlet end. In examples provided with multiple through-passages 26, the inlet and outlet ends of the through-passages may be connected with an inlet manifold and an outlet manifold respectively.

The cooling body 24 may be made of a material with good heat conducting properties, for example, aluminium or an aluminium alloy. When the cooling body 24 is in contact with the pump housing 14 (as shown in FIG. 1), a heat conducting path 44 is established via which heat generated in the pumping chamber 16 is conducted into the cooling body 24 via the pump housing 14. The heat received in the cooling body 24 can be conducted away in a flow of cooling fluid passing through the through-passage 26 so that the screw pump 10 is kept suitably cool.

Figure 4:
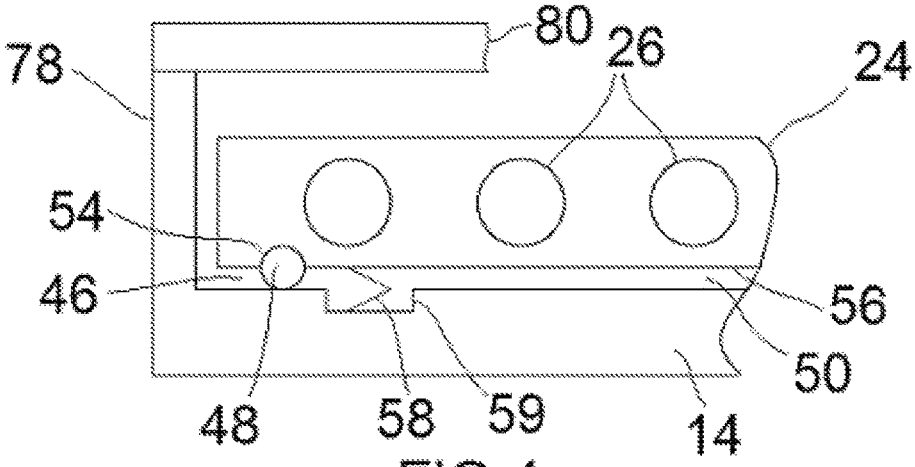
FIG. 4 is an enlargement of the circled portion of FIG. 2.

Referring to FIGS. 2 and 4, the pump cooling system 12 further comprises a cooling control mechanism operable to provide a gap 46 in the heat conducting path 44 when operating temperatures of the screw pump 10 are below a predefined temperature. The predefined temperature may be a desired operating temperature for the screw pump 10. The cooling control mechanism may comprise a seal 48 that defines, or establishes, a pressure chamber 50 between the pump housing 14 and cooling body 24 and a conduit 52 extending through the cooling body to allow evacuation and pressurisation of the pressure chamber. The seal 48 may be an endless sealing member trapped between the pump housing 14 and the cooling body 24. As best seen in FIG. 4, the seal 48 may be held in a groove 54 defined in a major surface 56 of the cooling body 24 that faces the pump housing 14 and engages the pump housing when the pump cooling system 12 is operating in cooling mode. Alternatively, the groove 54 may be provided in the pump housing 14. The seal 48 and groove 54 are configured such that the seal can be compressed sufficiently to allow the major surface 56 of the cooling body 24 to engage the pump housing 14 and close the gap 46 to establish the heat conducting path 44. Resilient biasing members 58 may be disposed between the pump housing 14 and the cooling body 24 to bias the cooling body away from the pump housing. The resilient biasing members 58 may comprise compression springs or spring washers. The resilient biasing members 58 may be seated in respective recesses 59 (FIG. 4) provided in one or both of the pump housing 14 and the major surface 56 of the cooling body 24 to allow the cooling body to engage the pump housing.

Figure 5:
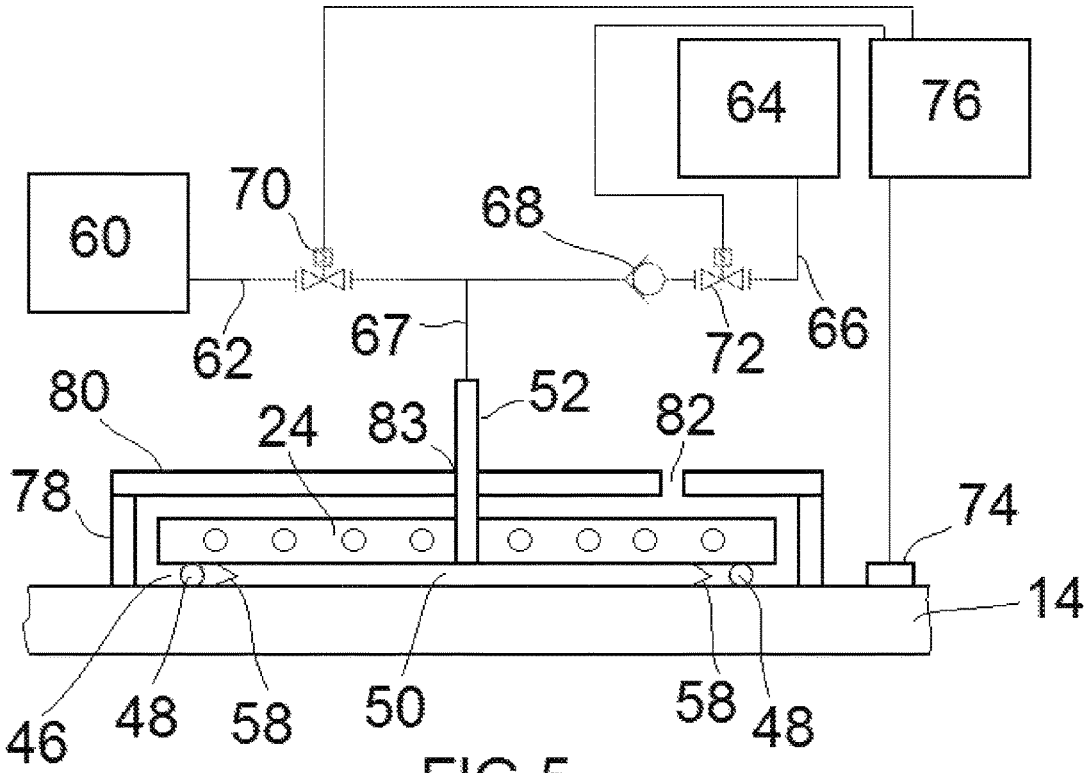
FIG. 5 is a schematic representation of a cooling control mechanism of the pump cooling system of FIGS. 1 to 4.

Referring to FIG. 5, the cooling control mechanism may further comprise a gas source 60 connected with the conduit 52 via piping 62 and a vacuum source 64 connected with the conduit 52 via piping 66 The gas source 60 may comprise any convenient form of compressed gas supply and the gas supplied may, for example, be dry compressed air or oxygen free nitrogen. The piping 62, 66 is connected with the conduit 52 by a common, connector, fitting or pipe 67. Although not essential, the vacuum source 64 may be the screw pump 10. If the vacuum source 64 is the screw pump 10, a one-way valve, or check valve, 68 may be provided in the piping 66 to prevent process material entering the pressure chamber 50. A powered valve such as an electrically actuable valve, which may be a solenoid valve 70, is provided in the piping 62 to enable selective opening and closing of the connection between the gas source 60 and the conduit 52. A powered valve such as an electrically actuable valve, which may be a solenoid valve 72, is provided in the piping 66 to enable selective opening and closing of the connection between the vacuum source 64 and the conduit 52.

The cooling control mechanism may further comprise one or more temperature sensors 74 and a controller 76. The temperature sensor, or sensors, 74 may comprise a thermocouple, or thermocouples, connected with the controller 76 and mounted at a suitable location, or locations, in or on the pump housing 14. The controller 76 is additionally connected with the solenoid valves 70, 72. The controller 76 may be a dedicated controller belonging to the cooling control mechanism or integrated, or incorporated, in a system controller that controls other functions of the screw pump 10 or apparatus connected with the pump.

Still referring to FIG. 5, the cooling body 24 and seal 48 may be enclosed to provide protection against impact damage and keep dirt away from the gap 46 and seal 48. The enclosure may comprise a side wall 78 that surrounds the cooling body 24 and a top cover 80. The side wall 78 projects outwardly with respect to the pump housing 14 and may be an integral part of the pump housing or a separate part, or parts, secured to it. The top cover 80 is secured to the side wall 78 by means of screws (not shown) or other suitable securing elements. The side wall 78 or top cover 80 may be provided with one or more vent holes 82. The conduit 52 is a clearance fit in an aperture 83 provided in the top cover 80 sufficient to allow movement of the cooling body 24 and conduit 52 relative to the top cover.

At start-up of the screw pump 10, the cooling body 24 may be in the position shown in FIGS. 2, 4 and 5 in which it is spaced from the pump housing 14 so that the pump cooling system 12 is in non-cooling mode. Thus, the screw pump 10 is not cooled while it works up to its desired operating temperature. The cooling body 24 is held in this position by the resilient biasing members 58 and the pressure force exerted on the major surface 56 of the cooling body by gas in the pressure chamber 50. Although not essential at this stage, a cooling fluid, typically water, may be supplied to the through-passage 26 of the cooling body 24. When signals from the temperature sensor 74, or sensors, indicate that the temperature of the pump housing 14 is greater than the desired operating temperature, the controller 76 causes the solenoid valve 72 to be opened so as to connect the pressure chamber 50 with the vacuum source 64 to allow evacuation of the pressure chamber. The strength of the resilient biasing members 58 is selected such that it is insufficient to resist the pressure force resulting from ambient pressure acting on the major surface 84 of the cooling body 24 that is opposite the major surface 56 and faces away from the pump housing 14. Accordingly, when the pressure chamber 50 is evacuated, the resilient biasing members are compressed and the cooling body is able to move into engagement with the pump housing 14. This closes the gap 46 in the heat conducting path 44 so that heat in the pump housing 14 is conducted into the cooling body 24 and conducted away from the screw pump 10 in the flow of cooling fluid flowing in the through passage 26.

When signals from the temperature sensor 74 indicate that the pump housing 14 has been cooled to a temperature below the desired operating temperature, the controller 76 causes the solenoid valve 72 to close and the solenoid valve 70 to open so that the pressure chamber 50 is connected with the gas source 60. Pressurised gas from the gas source 60 is then able to flow into the pressure chamber 50. The pressurised gas exerts a pressure force on the major surface 56 of the cooling body 24 that combined with the force exerted by the resilient biasing members 58 is sufficient to move the cooling body away from the pump housing 14 to open the gap 46 in the heat conducting path 44 and put the pump cooling system 12 in non-cooling mode. Heat from the screw pump 10 is then no longer conducted into the cooling body 24 so that cooling of the pump by the pump cooling system 12 at least substantially ceases. Because the pump cooling system 12 is operating in a non-cooling mode and its operation no longer affects the operating temperature of the screw pump 10, the flow of cooling fluid through the cooling body 24 can be maintained, which may at least substantially avoid the problem of calcification of the cooling body. When signals from the temperature sensor, or sensors, 74 indicate that cooling is again needed, the controller 76 causes the solenoid valve 70 to close and the solenoid valve 72 to open to cause a repeat of the process described above by which the pressure chamber 50 is evacuated and the cooling body 24 is moved into engagement with the pump housing 14 to close the gap 46 in the heat conducting path 44 and return the pump cooling system 12 to cooling mode.

Figure 6:
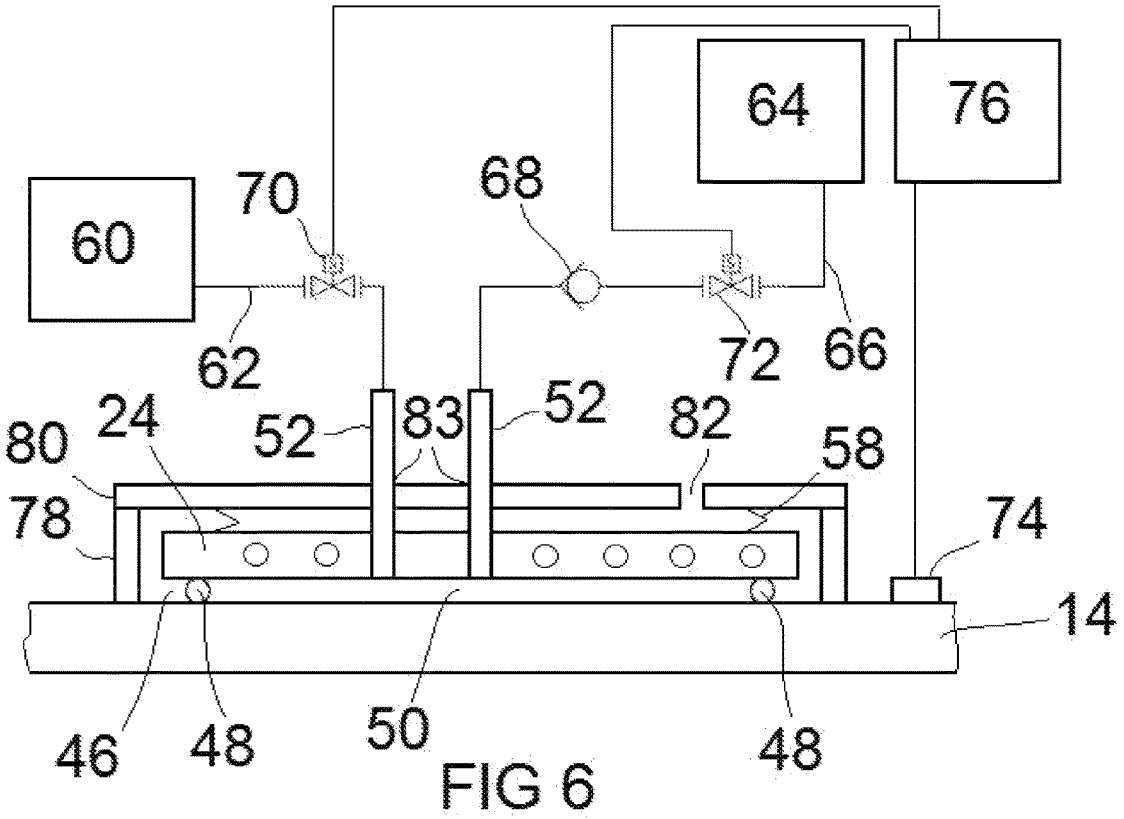
FIG. 6 is a schematic representation of another cooling control mechanism of the pump cooling system of FIGS. 1 to 4.

FIG. 6 shows a modified cooling control mechanism for the pump cooling system 12. The difference between the cooling control mechanism shown in FIG. 6 and the cooling control mechanism shown in FIG. 5 is that the gas source 60 and vacuum source 64 are connected with the pressure chamber 50 via respective separate conduits 52, rather than a common conduit. Also, the resilient biasing members 58 in the example shown in FIG. 6 are tension springs disposed between the top cover 80 and cooling body 24, rather than compression-type resilient members shown in FIG. 5.

In the examples illustrated by FIGS. 1 to 6, the pressure chamber is accessed for evacuation and pressurisation via at least one conduit extending through the cooling body. This is convenient, but not essential. In some examples one or more conduits for at least one of evacuating and pressurising the pressure chamber may be routed through the pump housing 14.

Figure 7:
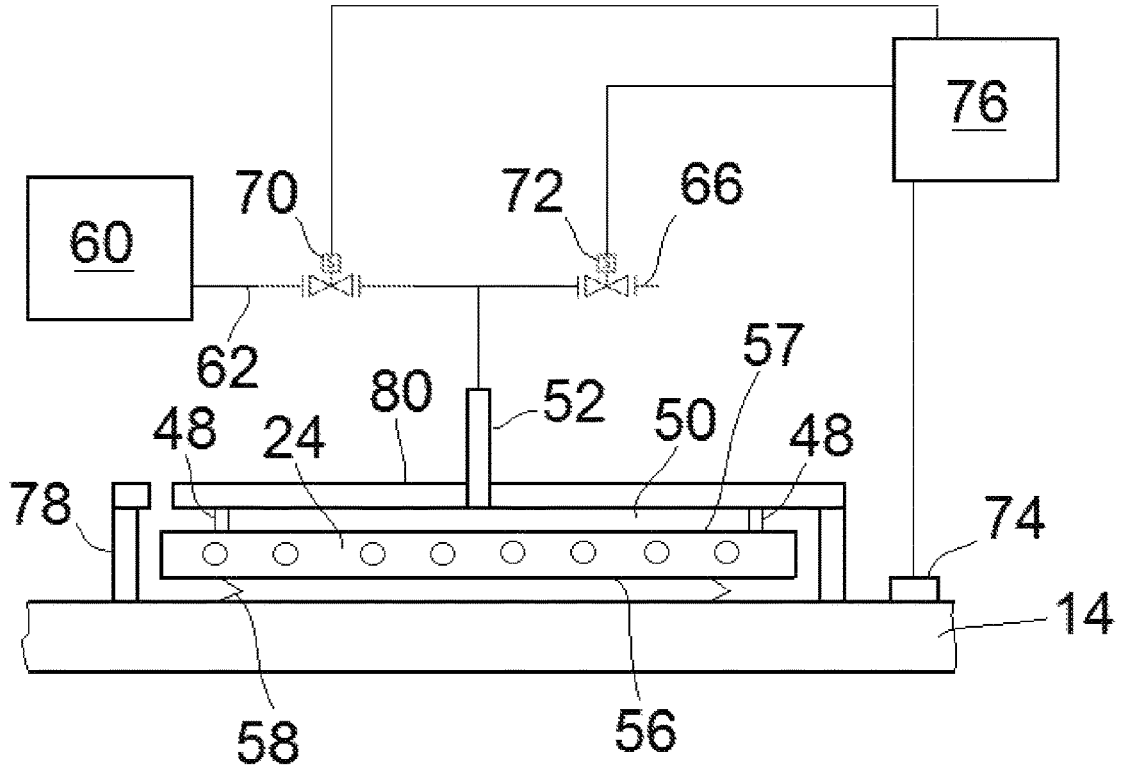
FIG. 7 is another cooling control mechanism for the pump cooling system of FIGS. 1 to 4.

FIG. 7 shows another cooling control mechanism for the pump cooling system 12. In this example, a pressure chamber 50 is defined between the major face 57 of the cooling body 24 that faces away from the pump housing 14 and the top cover 80. The pressure chamber is partially defined by a seal 48 disposed between the cooling body and the top cover 80. The seal 48 may be a polymer seal. The seal may be located in grooves or channelling provided in the major surface 57. In other examples, other resilient sealing elements such as a bellows may be used. An electrically actuable valve such as a solenoid valve 70 controls the connection of a pressurised gas source 60 with the pressure chamber 50 and an electrically actuable valve such as a solenoid valve 72 controls a connection between the pressure chamber and a vent 66. In use, when signals from one or more temperature sensor(s) 74 mounted in or on the pump housing 14 indicate a temperature above a desired operating temperature, the controller 76 provides signals that cause the solenoid valve 70 to open and the solenoid valve 72 to close. This allows pressurised gas from the gas source 60 to flow into the pressure chamber 50. The flow of pressurised gas increases the pressure in the pressure chamber 50 generating a pressure force that overcomes the oppositely directed force provided by the resilient biasing elements 58 and forces the cooling body 24 into engagement with the pump housing 14. This establishes a heat conducting path between the pump housing 14 and cooling body 24 so that heat from the pump can flow into the cooling body to be conducted away by the flow of cooling fluid passing through the one or more through-passages 26 provided in the cooling body. When signals from the one or more temperature sensors 74 indicate that the pump 10 has been cooled to the desired operating temperature, the solenoid valve 70 is closed and the solenoid valve 72 is opened to allow gas from the pressure chamber 50 to vent through the vent 66 as the resilient biasing members 58 move the cooling body 24 out of engagement with the pump housing 14. This opens a gap in the heat conducting path between the pump housing 14 and cooling body 24 so that conduction of heat from the pump housing to the cooling body is at least substantially interrupted and cooling of the pump by the cooling body 24 is at least substantially stopped.

Thus, the cooling control mechanism may comprise a pressure chamber 50 that, in use, can be selectively pressurised to control opening and closing of a gap in the heat conducting path 44. The cooling control mechanism may comprise powered valving 70, 72 actuable to selectively connect the pressure chamber 50 with at least one of a gas source 60 and a vacuum source 64 or vent 66 to selectively pressurise the pressure chamber. Although not essential, conveniently, the valving may comprise one or more electrically actuated valves, for example solenoid valves. In some examples, pneumatically or hydraulically actuated valving may be used. The cooling control mechanism, may further comprise a controller 76 and one or more temperature sensors 74 mounted in or on the pump housing 14. The controller 76 may be configured to provide signals that cause actuation of the valving 70, 72 to cause a variation in the gas pressure in the pressure chamber 50 to control the opening and closing of the gap in the heat conducting path 44 in response to signals provided by the one or more temperature sensors 74.

In examples not shown, the pressure chamber 50 may be defined by a separate body disposed between the pump housing 14 and cooling body 24 and separate to the cooling body. However, conveniently, the pressure chamber 50 may be partially defined by a major face 56, 57 of the cooling body 24 so that the pressurised gas acts directly on the cooling body. The pressure chamber 50 may be partially defined by a resiliently deformable sidewall 48. A resiliently deformable sidewall 48 allows the depth of the pressure chamber 50 to vary as the pressure of the gas in the pressure chamber is selectively varied.

Figure 8:
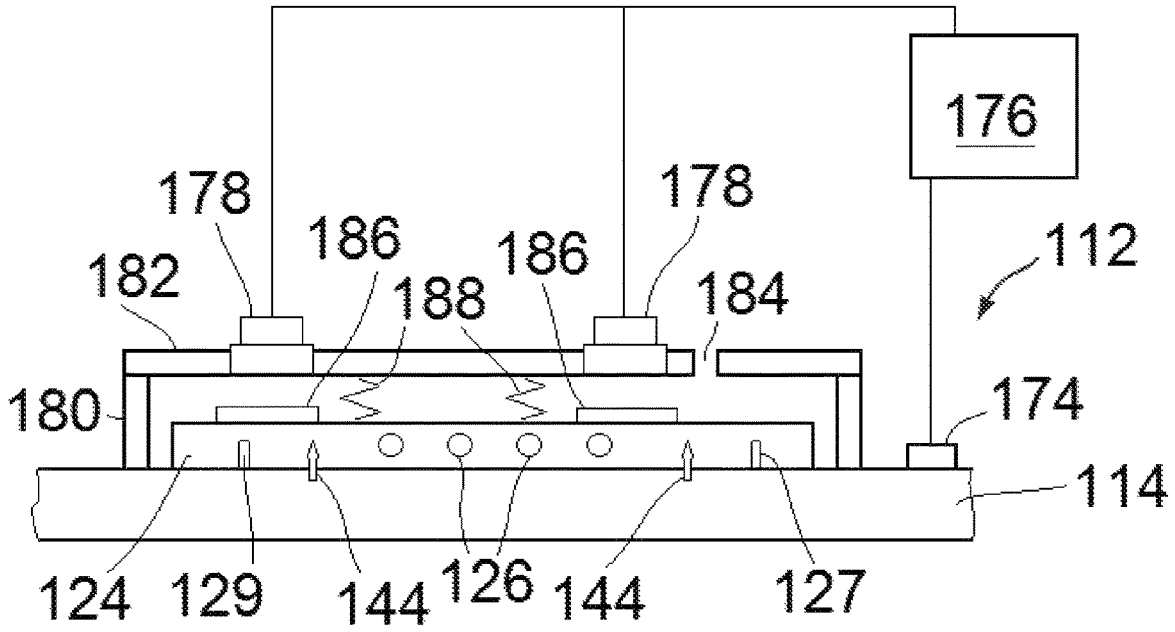
FIG. 8 is a schematic illustration of another pump cooling system showing the cooling system in cooling mode.

FIG. 8 schematically illustrates another pump cooling system and cooling control mechanism. The pump cooling system 112 may be fitted to a pump housing 114. The pump housing 114 may be a part of a screw pump analogous to the screw pump 10 shown in FIGS. 1 and 2, so for the sake of brevity no further description of the pump will be given here. The pump cooling system 112 comprises a cooling body 124 that has at least one through-passage 126 configured to channel a cooling fluid through the cooling body. The through-passage, or passages, 126 may be at least substantially as described above in connection with FIGS. 1 to 4. In this example, the cooling body 124 may be provided one or more bores 127 that receive respective guide members 129 projecting from the pump housing 114. The guide member, or members, 129 may comprise a pin, or pins, press fitted in respective holes (not shown) provided in the pump housing 114. The guide member, or members, 129 may prevent wandering of the cooling body 124 when moving into and out of engagement with the pump housing 114.

The cooling control mechanism may comprise at least one temperature sensor 174 to provide an indication of the temperature of the pump housing 114, a controller 176 and at least one electro-magnet 178. The controller 176 may be a dedicated microprocessor based controller, or embodied in a system controller that controls the pump or a processing system or apparatus associated with the pump. The controller 176 is configured to monitor signals from the temperature sensor, or sensors, 174 and when it is determined that cooling is not required, provide signals to activate the electromagnets 178 to cause the cooling body 124 to be lifted away from the pump housing 114 and held in a position in which it is spaced apart from the pump housing. Thus, if the signals from the temperature sensor, or sensors, 174 indicate a temperature below a desired operating temperature, the electromagnets 178 may be energised to lift and hold the cooling body 124 away from the pump housing 114. This provides a gap (not shown) in a heat conducting path 144 between the pump housing 114 and cooling body 124 so that heat conduction from the pump housing to the cooling body is at least substantially interrupted and the pump is a least substantially not cooled by the cooling body. This allows the provision of a continuous supply of cooling fluid into the cooling body 124 without overcooling, or unwanted cooling, of the pump. When signals from the temperature sensor, or sensors, 174 indicate a temperature above the desired operating temperature, the pump cooling system 112 can be put in cooling mode by de-energising the electromagnets 178.

The cooling body 124 may be enclosed by a side wall 180 and top cover 182 provided with at least one vent hole 184 in at least similar fashion to the cooling body 24 shown in FIGS. 1 to 6. Enclosing the cooling body 124 may advantageously reduce the likelihood of ingress of dirt between the pump housing 114 and cooling body and may provide a mounting for the electromagnets 178. In cases in which the cooling body 124 is made of a non-magnetic material such as aluminium, or an aluminium alloy, magnetically attractable bodies, such a steel plates, 186 may be provided on the cooling body opposite the electromagnets 178. In some examples, one or more resilient biasing members 188, for example coil springs or spring washers, may be provided between the top cover 182 and cooling body 124 so that when the electromagnets 184 are de-energised, the cooling body 124 is pushed back into engagement with the pump housing 114 so that the cooling body 124 is no longer held away from the pump housing and can resume engagement with the pump housing to close the gap in the heat conducting path 144.

In an alternative arrangement, resilient biasing elements may be provided between the pump housing 114 and cooling body 124 to push the cooling body away from the pump housing and one or more electromagnets may be provided between the pump housing and cooling body such that when energised, the magnetic force produced by the electromagnet, or electromagnets, overcomes the biasing force and the cooling body is drawn into engagement with the pump housing. The electromagnet, or electromagnets, may be housed in suitable recesses provided in the pump housing 114, in which case it would be necessary to provide magnetically attractable members on a non-ferrous cooling body. Alternatively, in a potentially simpler arrangement, the electromagnet, or electromagnets, may be provided on the cooling body to work against ferrous components of the pump housing 124. To facilitate engagement between the cooling body and pump housing, the or each electromagnet may be embedded in the cooling body or recessing may be provided in the pump housing to at least partially receive the electromagnets when the cooling body is drawn into the pump housing.

In the examples described above, active electromagnets are energised to provide a magnetic force to move the cooling body in a required direction and hold it away from the pump housing. It is to be understood that in other examples, one or more permanent, or latching, electromagnets may be used instead.

In some examples, respective sets of electromagnets may be provided to move the cooling body into and out of engagement with the pump housing. This may be desirable in examples in which the orientation of the pump or the pump cooling system does not allow, or makes unreliable or difficult, movement of the cooling body in one or the other direction in reliance on gravitational force or resilient biasing mechanisms.

Figure 9:
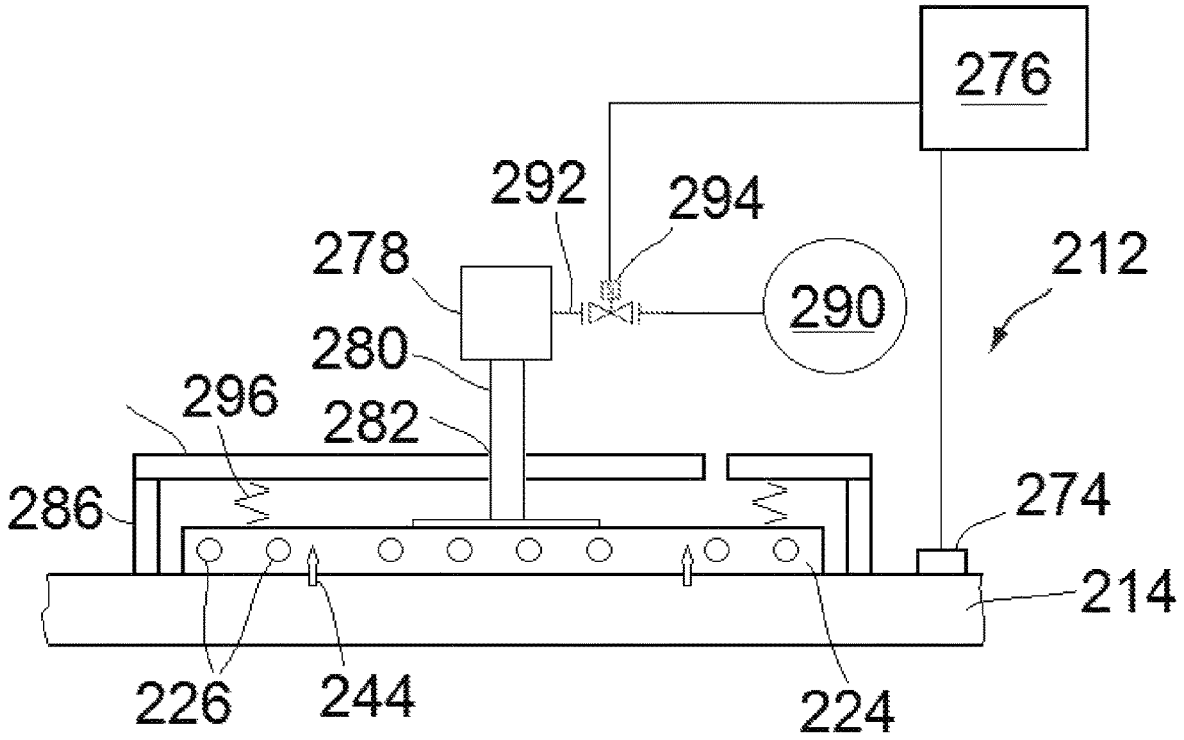
FIG. 9 is a schematic illustration of yet another pump cooling system showing the cooling system in cooling mode.

FIG. 9 schematically illustrates another pump cooling system and cooling control mechanism. The pump cooling system 212 shown in FIG. 8 differs from the pump cooling system 112 primarily in that instead of using an electromagnet, or electromagnets, one or more fluid actuated cylinders 278 are used to move the cooling body 224 away from the pump housing 214. Although in some examples a hydraulic cylinder may be used, the illustrated example has one pneumatic cylinder 278. The pneumatic cylinder 278 has a ram 280 that extends through an aperture 282 provided in the top cover 284 of an enclosure 284, 286 in which the cooling body 224 is housed. The pneumatic cylinder 278 is connected with a source of compressed gas 290 by piping 292. The compressed gas may be compressed air. A valve 294 is provided in the piping 292 to control the flow of compressed gas to the pneumatic cylinder 278. The valve 294 may be an electrically actuable valve such as a solenoid valve. The valve 294 is connected with the controller 276 so that it can be actuated by signals from the controller.

The pneumatic cylinder 278 may be a single acting cylinder operating against one or more resilient biasing members 296 that bias the cooling body 224 into engagement with the pump housing 214. There may be a plurality of biasing members 296 that are mounted independently of the pneumatic cylinder 278 as shown in FIG. 8. The biasing members 296 may be coil springs. Alternatively, or additionally, there may be a coil spring mounted about the ram 286 to act between the top cover 284 and the cooling body 224.

In some examples, instead of a single acting pneumatic cylinder as illustrated in FIG. 9, there may be a double acting pneumatic cylinder, in which case the resilient biasing members 296 may be omitted.

In use, if the signals from the temperature sensor, or sensors, 274 indicate that the temperature of the pump housing 214 is below a desired operating temperature, the controller 276 may cause the solenoid valve 294 to open to supply compressed air to the pneumatic cylinder 278 to cause the ram 280 to retract and draw the cooling body 224 away from the pump housing 214. This provides a gap, or break, (not shown) in a heat conducting path 244 between the pump housing 214 and cooling body 224 so that heat conduction from the pump housing to the cooling body is at least substantially interrupted and the pump is at least substantially not cooled by the cooling fluid flowing through the cooling body. This allows the provision of a continuous supply of cooling fluid into the cooling body 224 without overcooling or unwanted cooling of the pump. When signals from the temperature sensor, or sensors, 274 indicate temperatures above the desired operating temperature, the pneumatic cylinder 278 may be vented to allow the cooling body 224 to be moved back into engagement with the pump housing 214 by the biasing force exerted by the resilient biasing members 296, thus returning the pump cooling system 212 to cooling mode.

Figure 10:
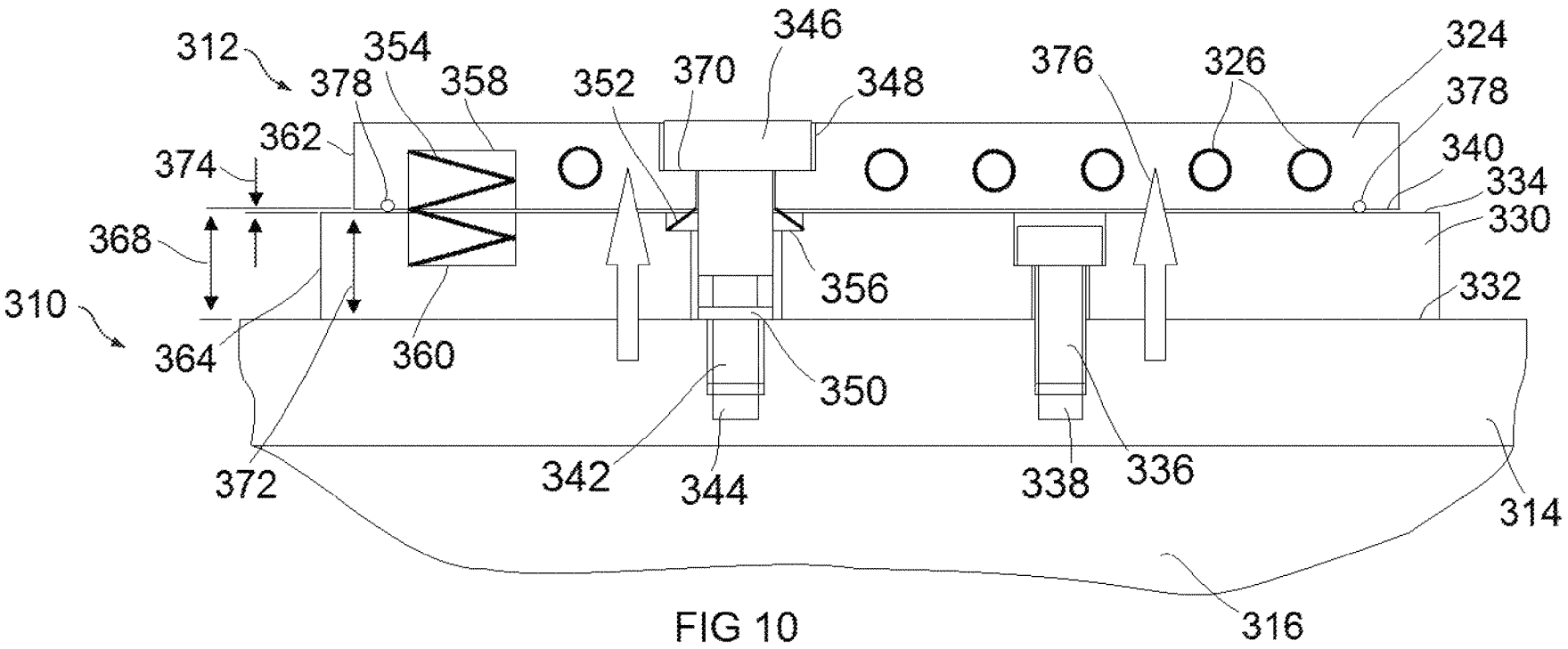
FIG. 10 is a schematic illustration of still another pump cooling system showing the cooling system in non-cooling mode.
Figure 11:
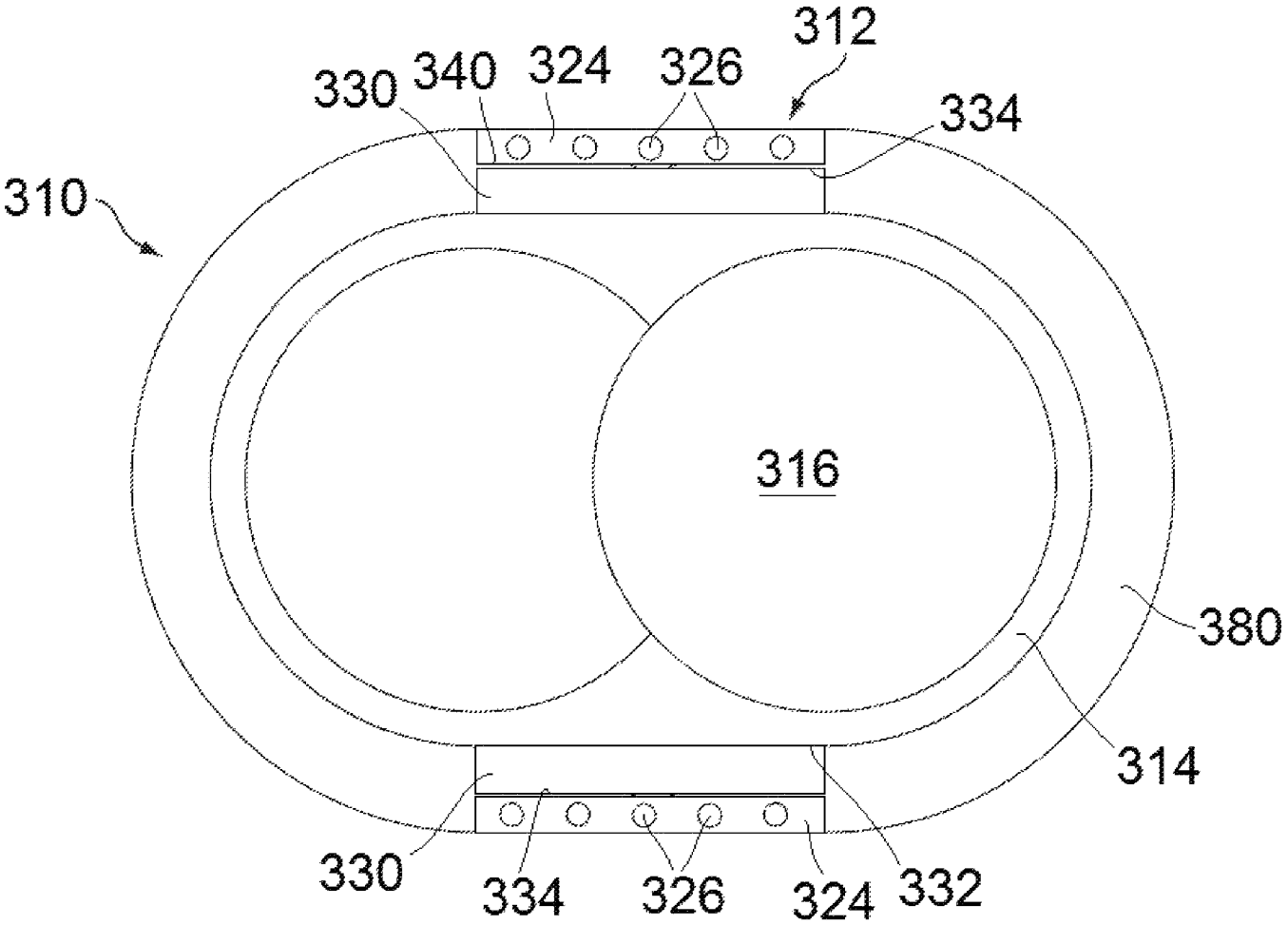
FIG. 11 is a schematic transverse section view of a screw pump provided the pump cooling system of FIG. 10.

In the example shown in FIG. 9, the fluid actuated cylinder 278 is used to move the cooling body 224 away from the pump housing 214 and resilient biasing members 296 in conjunction with gravitational forces are used to move the cooling body into engagement with the pump housing. In different orientations of the pump or the pump cooling system, it may be desirable to configure the pump cooling system such that the fluid actuated cylinder is used to move the cooling body into engagement with the pump housing. For example, if the arrangement shown in FIG. 9 is inverted so that the pump housing 214 is above the cooling body 224, the fluid actuated cylinder 278 may be used to push the cooling body into engagement with the pump housing and one or more resilient members may be provided between the pump housing and cooling body to bias the cooling body away from the pump housing FIGS. 10 and 11 illustrate schematically a screw pump 310 fitted with a pump cooling system 312. The screw pump 310 may be similar to or the same as the screw pump 10 shown in FIGS. 1 and 2, so for the sake of brevity no detailed description of the pump will be given here. The screw pump 310 comprises a pump housing 314 that defines a pumping chamber 316 that houses a pair of meshing screw rotors (omitted from FIGS. 10 and 11). The pump cooling system 312 comprises a cooling body 324 provided with at least one through-passage 326. The through-passage, or passages, 326 and connection system by which a connection is made with a supply of cooling fluid may be at least substantially as described above with reference to FIG. 3. The pump cooling system 312 additionally comprises a heat conducting body, or heat distribution body, 330 disposed between the cooling body 324 and the pump housing 314. The cooling body 324 and the heat conducting body 330 may be made of the same material, for example, aluminium or an aluminium alloy.

Although the description relating to FIGS. 10 and 11 will refer to a cooling body 324 and heat conducting body 330 in the singular, it is to be understood that the pump cooling system 312 may comprise multiple cooling bodies and respective heat conducting bodies. For example, as shown in FIG. 11 there may be two cooling bodies 324 and respective heat conducting bodies 330. The two cooling bodies 324 may be disposed opposite one another on opposite sides of the pump housing 314.

The heat conducting body 330 may be a plate-like body that has a first major surface 332 and a second major surface 334 disposed opposite and spaced apart from the first major surface. The heat conducting body 330 is secured to the pump housing 314 with the first major surface 332 facing and engaging the outer side of the pump housing 314. The heat conducting body 330 may be secured to the pump housing 314 by a plurality of bolts 336 that pass through the heat conducting body and engage in respective threaded apertures 338 provided in the pump housing 314. The bolts 336 ensure that the heat conducting body 330 is held at least substantially immovably in engagement with the pump housing 314.

Still referring to FIG. 10, the cooling body 324 may be a plate-like body that has a first major surface 340 disposed in facing relationship with the second major surface 334 of the heat conducting body 330. The cooling body 324 is secured to the pump housing 314 by a plurality of bolts 342 that pass through the cooling body and the heat conducting body 330 and engage in respective threaded apertures 344 provided in the pump housing 314.

The bolts 342 each have a head 346 that is received in a respective recess 348 defined in the cooling body 324. The bolts 342 are each provided with an integral flange, or washer, 350 that has a transverse surface that engages the outer side of the pump housing 314. A plurality of resilient biasing members 352, 354 are provided between the cooling body 324 and the heat conducting body 330. The resilient biasing members 352, 354 are configured to provide a biasing force that biases the cooling body 324 away from the pump housing 314 and heat conducting body 330. The biasing members 352 may take the form of a compression spring or wave washer fitted around a bolt 342 and disposed in a recess 356 defined in the second major surface 334 of the heat conducting body 330. The configuration of the recess 356 and the resilient biasing member 352 is such that the resilient biasing member is able to engage the first major surface 340 of the cooling body 324 to exert a force on the cooling body that is outwardly directed with respect to the pump housing 314 and the heat conducting body 330. Alternatively, or additionally to the one or more resilient members 352, there may be one or more resilient biasing members 354 located independently of the bolts 342. For example, a resilient biasing member 354 may be disposed in a recess defined in one of the cooling body 324 and heat conducting body 330, or as shown in FIG. 9, in respective oppositely disposed recesses 358, 360 defined in the cooling body 324 and heat conducting body 330. The resilient biasing member 354 may be a compression spring as shown in FIG. 9. The recesses 358, 360 may be disposed adjacent respective sides 362, 364 of the cooling body 324 and heat conducting body 330.

The arrangement of the resilient biasing members 352, 354 is such that a substantially uniform biasing force is applied to the cooling body 324 pushing it away from the pump housing 314 so that the major surface 340 of the cooling body 324 is held a distance 368 from the pump housing. Although not essential, the distance 368 may be at least substantially uniform. The distance 368 is determined by the distance between the transverse surface of the flange 350 that engages the pump housing 314 and a transverse surface defined by the underside 370 of the bolt head 346 that engages the base of the recess 348. The thickness 372 of the heat conducting body 330 at ambient temperatures is less than the distance 368 so that there will be a gap 374 between the cooling body 324 and the heat conducting body 330 that at least substantially interrupts a heat conducting path 376 between the pump housing 314 and cooling body 324. Preferably at least one seal 378 is provided adjacent the periphery of the cooling body 324 to prevent the ingress of dirt and the like so as to maintain cleanliness in the gap 374.

The coefficient of thermal expansion of the bolts 342 is less than the coefficient of thermal expansion of the heat conducting body 330 so that, in use, when the operating temperature of the screw pump 310 is above a desired operating temperature, thermal expansion of the heat conducting body closes the gap 374 in the heat conducting path 376 so that heat from the screw pump is conducted to the cooling body 324 via the heat conducting body 330. Also, since the bolts 342 provide a permanent thermal bridge between the pump housing 314 and cooling body 324, it is desirable that their thermal conductivity is relatively low. It is also desirable that the head 346 of the bolt 342 is relatively large, or wide, compared with a conventional, or standard, bolt of the same diameter in order to provide a high contact area with the cooling body 324. This is so that the bolt may be cooled during operation of the screw pump 310 to at least assist in minimising fluctuations in the distance 368. The bolts 342 and heat conducting body 330 may, for example, be made of stainless steel and aluminium respectively. In other examples, the bolt 342 may be made of Invar 36, which is a 36% Ni Fe metal with a low coefficient of thermal expansion. Invar 36 bolts will be known to those skilled in the art. Thus, a cooling control mechanism is provided so that there is a gap 374 in the heat conducting path 376 between the pump housing 314 and cooling body 324 when the operating temperature of the pump is below a predefined temperature.

It may be desirable to operate pumps at relatively high temperatures to prevent condensation of pumped gases in the pumping chamber. For example, it may be desirable to operate at temperatures in the range 180 to 320° C. Obtaining a relatively high operating temperature may at least in part be obtained by having a pump cooling system that only operates in cooling mode when the operating temperature of the pump exceeds a desired operating temperature. However, when operating at ultimate, or close to the lowest achievable pressure, a vacuum pump may generate relatively small amounts of heat so that the operating temperature is below the desired operating temperature, even though the pump cooling system is not operating in cooling mode. The pump may be provided with thermal insulation to retain heat to assist in maintaining a relatively high operating temperature. Thus, as shown in FIG. 11, the screw pump 310 may be provided with one or more layers of thermal insulation 380. The thermal insulation 380 may be secured to the pump housing 314 by, for example, bands (not shown) extending about the pump housing and may comprise foamed silicone or an aerogel. The heat retention provided by the thermal insulation 380 coupled with operation of the pump cooling system 312 in non-cooling mode at start up and when the operating temperature of the pump is at or below the desired operating temperature may enable the pump to reach the desired operating temperature quicker than conventional pumps and then maintain the desired operating temperature, even when operating at ultimate.

Figure 12:
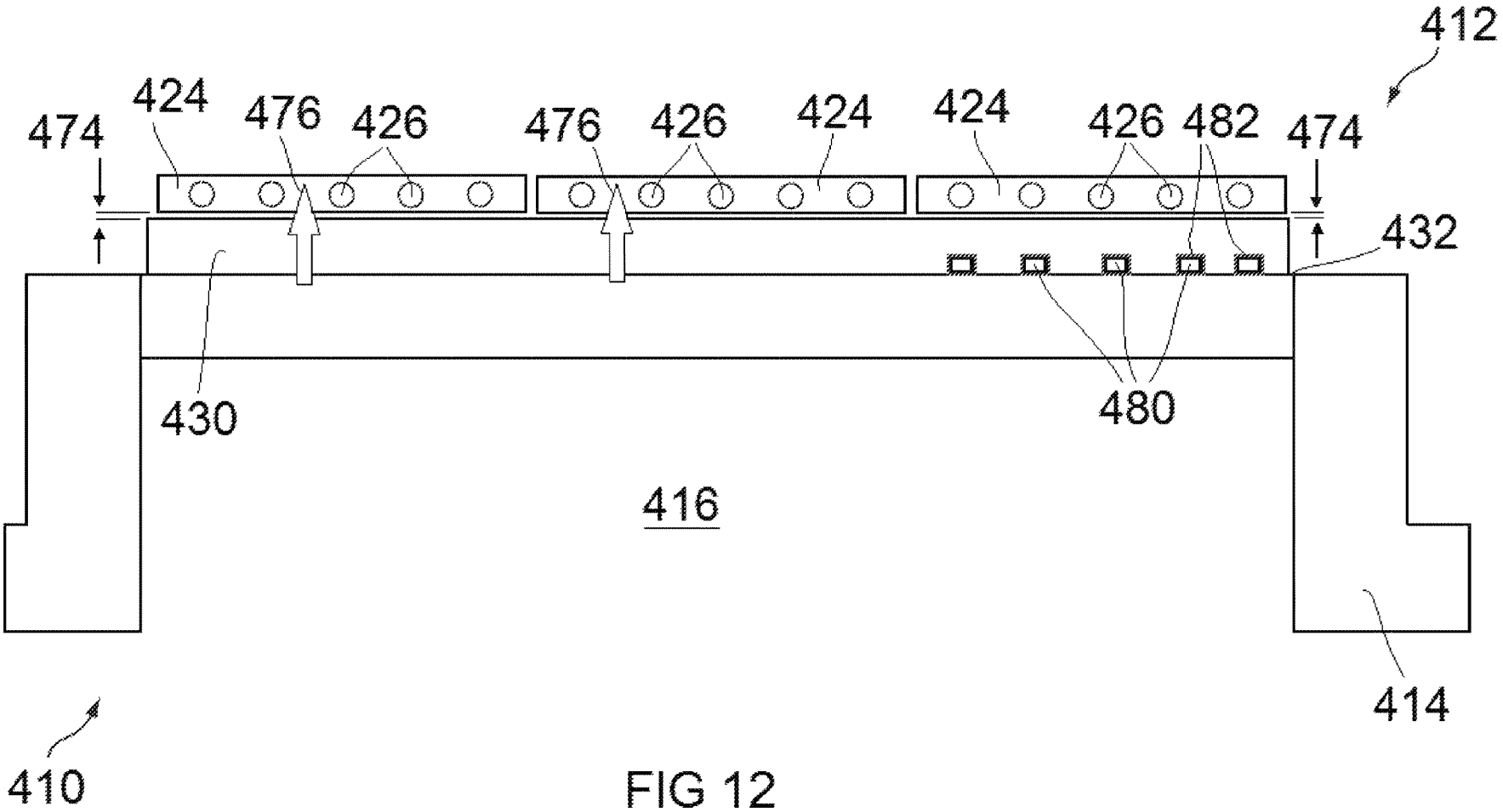
FIG. 12 shows a modification to the pump cooling system shown in FIGS. 10 and 11.

FIG. 12 shows a pump cooling system 412 that is a modification of the pump cooling system 312 illustrated by FIGS. 10 and 11. The pump cooling system 412 is fitted to the pump housing 414 of a screw pump 410. In this example, there are multiple cooling bodies 424 that each have at least one through passage 426. A heat conducting body, or heat distribution body, 430 is secured to the pump housing 414 between the outer surface 432 of the pump housing and the cooling bodies 424. The cooling bodies 424 and heat conducting body 430 may be made of the same material, for example, aluminium or an aluminium alloy. The cooling bodies 424 may be secured to the pump housing 414 in the same or similar fashion to the cooling body 324 shown in FIG. 10 and in the same way, resilient biasing members may be provided between the heat conducting body 430 and cooling bodies 424 so that at ambient temperatures a gap 474 is maintained between the heating conducting body and the cooling bodies. In this example, the respective gaps 474 between the cooling bodies 424 and heat conducting body 430 are different so that the respective heat conducting paths 476 between them are established at different temperatures. Accordingly, the cooling bodies 424 will be put in cooling mode by thermal expansion of the heat conducting body 430 at different temperatures. The narrowest of the respective gaps 474 may be provided between the heat conducting body 430 and the cooling body 424 that is closest to the downstream, or outlet, end of the pump chamber 416 (the right-hand end as viewed in the drawing). The respective gaps 474 between the cooling bodies 424 and the heat conducting body 430 may be progressively narrower in the direction towards the outlet end of the pumping chamber 416.

The pump cooling system 412 may additionally comprise one or more heating units 480. The heating unit, or units, 480 may be energised when the screw pump 410 is operating at ultimate in order to maintain a desired pump operating temperature when the heat generated by pumping relatively low volumes of gas is insufficient to maintain that temperature. The heating unit, or units, 480 may comprise one or more electrical resistance elements fitted between the pump housing 414 and heat conducting body 430. The heating unit, or heating units, 480 may be housed in recesses (not shown) provided in the pump housing 414 or recesses 482 provided in the heat conducting body 430 or a combination of the two. The heating unit, or units 480 may be switchable on the basis of signals received from temperature sensors (not shown) or on a detection of the current supplied to the motor that drives the screw pump 410.

In a modification of the pump cooling system 412 shown in FIG. 12, instead of having a single heat conducting body 430, there may be respective separate, or discrete, heat conducting bodies associated with the respective cooling bodies 424. This may allow cooling to provide different temperatures in different regions of the screw pump 410.

Figure 13:
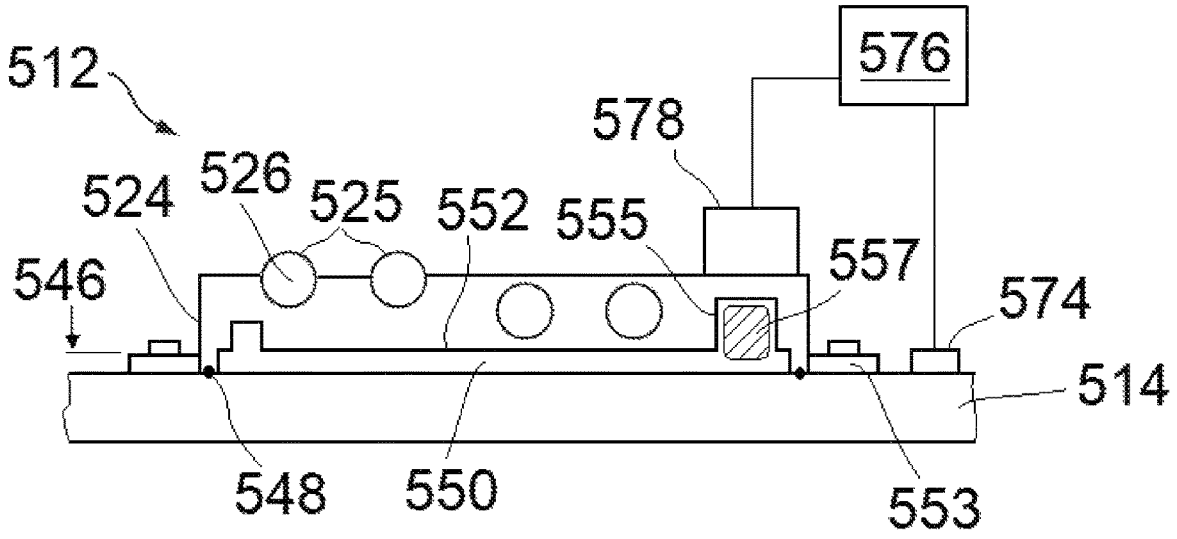
FIG. 13 is a schematic illustration of a further pump cooling system showing the cooling system in non-cooling mode.
Figure 14:
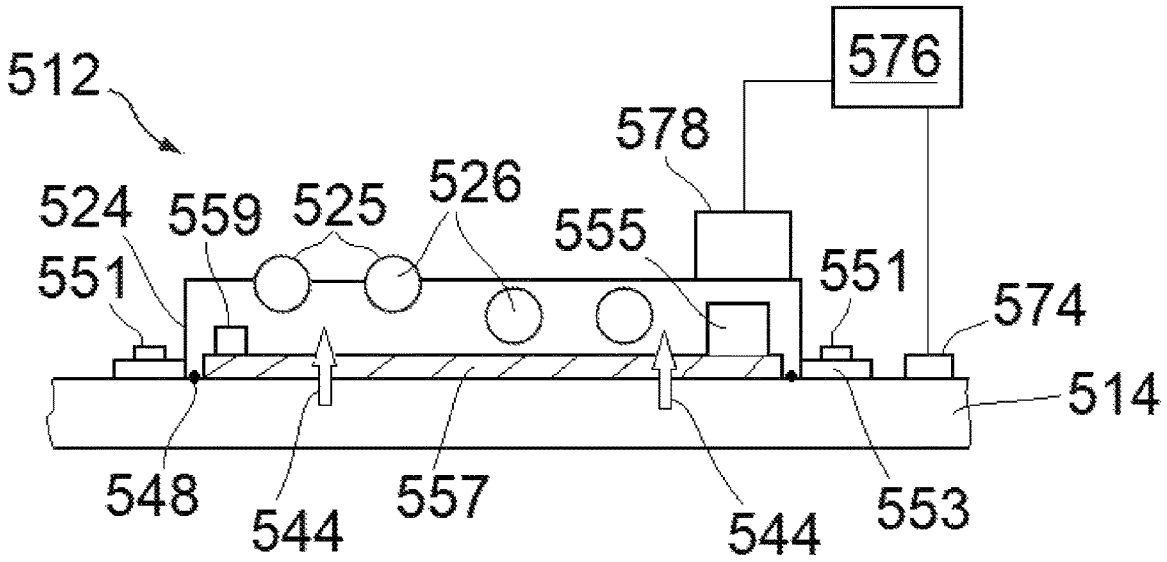
FIG. 14 shows the pump cooling system of FIG. 13 in cooling mode.

Referring to FIGS. 13 and 14, yet another example of a pump cooling system 512 comprises at least one cooling body 524 disposed about a pump housing 514. The pump housing 514 may be a part of a screw pump analogous to the screw pump 10 shown in FIGS. 1 and 2 and so for the sake of brevity no further description of the pump will be given here. The pump cooling system 512 may comprise any number of cooling bodies 524 depending on one or more of, for example, the desired cooling capacity, the particular localised cooling requirements and ease of fitting to the pump housing 514. For convenience, in the description that follows, reference will be made to one cooling body 524 without implying any limitation on the number of cooling bodies 524 used in the pump cooling system 512.

The cooling body 524 may have at least one through-passage 526 through which, in use, a cooling fluid is passed to conduct heat away from the cooling body. The or each through-passage 526 may be at least substantially as described above in connection with FIGS. 1 to 4. Also as previously described, the cooling body 524 may be formed of multiple body parts joined to one another. In other examples, the or at least one through-passage may be defined by a pipe 525 pressed into recessing provided in the cooling body 524 as shown on the lefthand side of the cooling body shown in FIGS. 13 and 14. It will be understood that pipes pressed into recessing of the cooling body may similarly be used to define one or more through-passages in the examples illustrated by FIGS. 1 to 12.

The pump cooling system 524 further comprises a cooling control mechanism operable to provide a gap 546 in a heat conducting path 544 between the pump housing 514 and the cooling body 524. The gap 546 may be defined by a space, or chamber, 550 provided between the pump housing 514 and cooling body 524. The chamber 550 may be defined by recessing 552 comprising one or more recesses provided in the major face of the cooling body 524 that in use faces the pump housing 514. This is not essential, as the chamber 550 may be defined by recessing comprising one or more recesses provided in the pump housing 514 or a combination of respective recessing provided in the pump housing and cooling body 524. In other examples, the space, or chamber, may be defined by a hollow body disposed between the pump housing 514 and cooling body 524. One or more seals 548 may be provided between the pump housing 514 and cooling body 524 so that the chamber 550 is liquid tight. Although not essential, sealing may be provided by an endless seal such as an O-ring 548. The seal or seals 548 may be received in recesses, or grooves, provided in one or both of the pump housing 514 and cooling body 524.

The cooling body 524 may be secured to the pump housing by any convenient known means, for example by studs or bolts 551 extending through suitable apertures that may be provided in flanges 553 attached to the cooling body. Alternatively, or additionally, clamps (not shown) may be used to secure the cooling body 524 to the pump housing 514.

The cooling control mechanism further comprises a liquid reservoir 555 that opens into the chamber 550 and is configured to hold a heat conducting body comprising a body of liquid 557. In the illustrated example, the liquid reservoir 555 is shown provided in the cooling body 524 and disposed to one side of the cooling body 524. However, this is not essential as it may be located in any convenient position and there may be more than one liquid reservoir. in some examples, the liquid reservoir may be provided in the pump housing 514 or in a separate body connected with the pump housing or cooling body. In the description that follows, reference will be made to a single liquid reservoir 555 provided in the cooling body 524 as shown in FIGS. 13 and 14, but this is not to be taken as implying any limitation.

The liquid 557 may have good thermal conductivity. The liquid 557 may have magnetic properties, for example, as exhibited by ferrofluids and ionic fluids.

The cooling control mechanism further comprises at least one temperature sensor 574, a controller 576 and an actuator, which in the illustrated example is an electromagnet 578. The or each temperature sensor 574 is arranged on the pump housing 514 to sense, or detect, the temperature of the pump housing and is connected with the controller 576 to provide the controller with signals indicative of the local temperature of the pump housing. The controller 576 may, for example, be a dedicated microprocessor based controller or a part of a controller for the pump or apparatus associated with the pump. The electromagnet 578 is disposed on the cooling body 578 adjacent the liquid reservoir 555 so as to be capable of applying a magnetic force to draw the liquid 557 into the liquid reservoir.

In use, at start up or when signals from the temperature sensor 574 indicate that the pump operating temperature is below a predefined temperature, the controller 576 may cause the electromagnet 578 to be energised so that a magnetic force can be applied to the magnetic liquid 557. The positioning of the electromagnet 578 relative to the liquid reservoir 555 may be such that the magnetic force draws the magnetic liquid 557 into the liquid reservoir so that the chamber 550 is at least substantially emptied of the magnetic liquid, thereby opening a gap 546 in the heat conducting path 544 between the pump housing 514 and the cooling body 524. Accordingly, even if a cooling fluid is continuously passing through the or each through-passage 526, the pump cooling system 512 provides at least substantially no cooling for the pump housing 514. When signals from the temperature sensor 574 indicate that the temperature of the pump housing 514 is above a predefined temperature, the controller 576 may cause the electromagnet 578 to be de-energised so that it no longer applies a magnetic force to the magnetic liquid 557. The thus released magnetic liquid 557 is able to flow under the influence of gravity from the liquid reservoir 555 into the chamber 550 so that the gap 546 in the heat conducting path 544 is closed and heat is conducted from the pump housing 514 to the cooling body 524 via the magnetic fluid 557 to be conducted away by the cooling fluid flowing through the at least one through-passage 526.

It will be understood that in the orientation shown in FIGS. 13 and 14, the magnetic liquid 557 may be drawn from the chamber 550 into the reservoir by a magnetic force applied by the electromagnet 578 and flow back into the chamber 550 under the influence of gravity. It will also be understood that if the pump cooling system 512 is rotated through 180° from the orientation shown in FIGS. 13 and 14 so that the chamber 550 is above the liquid reservoir 555, the electromagnet 578 may be located in a position in which it is able to apply a magnetic force that draws the magnetic liquid 557 from the liquid reservoir 555 into the chamber 550 and the liquid is able to return to the liquid reservoir under the influence of gravity when the electromagnet is de-energised. Thus, for example, for operation in that orientation, the electromagnet 578 may be disposed in the pump housing 514. However, it may be advantageous where possible to mount the electromagnet 578 on the cooling body 524 so that it can be permanently cooled and not exposed to the high temperatures that may be present in the pump housing 514. Although not shown in FIGS. 13 and 14, it will be understood that the recessing 552 may be configured such that the chamber 550 has one or more 'lowermost positions' disposed remote from the liquid reservoir 555 to encourage the magnetic liquid to flow from the liquid reservoir and fill the chamber. Additionally, recessing 559 may be provided to receive air displaced by the magnetic liquid 557 when filling the chamber 550.

In the illustrated example, an electromagnet is used to apply a magnetic force by which the magnetic liquid is moved. In other examples, the magnetic liquid may be moved by a movable permanent magnet. For example, a permanent magnet may be mounted on a suitable mechanism or actuator by which it can be moved into or away from a position in which it is able to apply a magnetic force to the magnetic liquid. Suitable mechanisms or actuators may include a stepper motor or fluid powered actuators. Some examples may comprise a system of permanent magnets in which one or more first permanent magnets is movable relative to one or more second permanent magnets so as to cancel the magnet field of the second permanent magnet or magnets. Such a cooling control mechanism needs a mechanism or actuator to move the one or more first permanent magnets. It will be understood that using an electromagnet to move the magnetic liquid may prove advantageous in that the only moving part in the cooling control mechanism is the body of magnetic liquid.

In the illustrated example, the heat conducting body that is used to fill the chamber 550 to selectively open and close the gap 546 in the heat conducting path 544 is a body of magnetic liquid. In other examples, a non-magnetic liquid may be used in conjunction with a suitable mechanism or actuator capable of pushing the liquid into or pulling it out of the gap between the pump housing and cooling body. For example, a fluid powered piston may be used to push a non-magnetic liquid from a reservoir against gravitational forces to fill the gap in the heat conducting path and retracted to allow the liquid to fall back into the reservoir under the influence of gravity. In still other examples, the heating conducting body may be a solid body that can be at least partially withdrawn from the chamber to open a gap in the heat conducting path.

It will be understood that although not shown in FIG. 1 to 9 or 13 and 14, one or both of thermal insulation and heating units as described with reference to FIGS. 10 to 12 may be used with the pumps and pump cooling systems shown in FIGS. 1 to 9 or 13 and 14.

The provision of a pump cooling system configured to selectively provide a gap in a heat conducting path between the pump housing and a cooling body at temperatures below a predefined operating temperature of the pump allows a flow of cooling fluid through the cooling body to be maintained even when pump cooling is not required. This may prevent calcification of the cooling body without overcooling, or otherwise unnecessary cooling, of the pump. Thus, the pump operating temperature may be maintained at, or closer to, a desired operating temperature, without having to shut off the supply of cooling fluid to the cooling body. An improved ability to operate at relatively high operating temperatures when the pump is pumping low volumes and so generating relatively low amounts of heat may be provided in examples in which the pump is provided with one or both of thermal insulation and a heating unit, or units. This is because the heat that is generated will be retained, or heat input may be provided when needed.

In the description of the illustrated examples, the predefined temperature at which the gap in the heat conducting path opens is described as being a desired operating temperature of the pump. It will be understood that this is not essential and that in some examples, the predefined temperature may be a little higher or lower than the actual desired operating temperature. In examples in which the cooling body is moved relative to the pump housing, the predefined temperature at which the gap is opened may be above the desired operating temperature and the gap may be closed at a lower temperature to reduce the frequency with which the cooling body has to be moved into and out of engagement with the pump housing.

Conveniently, cooling bodies, and when provided any non-liquid heat conducting body, may be flat, or planar, bodies configured to engage flat surfaces provided on the pump housing. However, this is not essential and it is to be understood that the cooling bodies, or non-liquid heat conducting bodies, or at least the pump engaging surface thereof, may be contoured to complement a contour of the pump housing.

It is to be understood that the gap between the cooling body and pump housing or heat conducting body shown in the drawings may be exaggerated for the sake of clarity of the drawings and that in practice the gap may be very small. For example, the gap may be in the range 0.1 to 1.0 mm.

In the examples shown in FIGS. 1 to 9, the cooling bodies are shown to directly engage the pump housing. This is not essential. In some examples, it may be desirable to provide a heat conducting body between the cooling body and pump housing. This may for example facilitate providing a flat surface for the cooling body to move against as opposed to having to modify the contours of a pump housing or providing a contoured pump engaging surface on the cooling body.

It is to be understood that the term 'through-passage' used in conjunction with a cooling body does not require that the passage extends from one side or end to the other side or end of the cooling body. It merely requires that the passage, or passages, pass through the cooling body so that a cooling fluid can pass through at least a portion of the cooling body to conduct heat away from the cooling body. Thus, for example, in the arrangements shown in FIGS. 10 to 14, the inlet or outlet end, or both, of a through-passage may be disposed in a major face of the cooling body that faces away from the pump housing. Furthermore, the cross-sectional area of a through-passage may vary over its length.

In examples in which there is more than one cooling body, there may be a cooling control mechanism or mechanisms configured so that the respective gaps that interrupt the heat conducting path are closed at different temperatures as, for example, described above with reference to FIG. 12

The pump cooling systems have been described in use with screw pumps. It is to be understood that the disclosure is not limited to use with screw pumps and may in principle be applied to any pump that requires cooling. The disclosure is particularly applicable to cooling twin shaft dry vacuum pumps. The disclosure may be applied to multi-stage Roots pumps.

The invention claimed is:

1. A pump cooling system comprising:

a cooling body configured to be fitted to a pump housing to receive heat from the pump housing via a heat conducting path between the cooling body and the pump housing, the cooling body having a passage through which, in use, a cooling fluid is passed to conduct heat away from the cooling body; and a cooling control mechanism configured to provide a gap in the heat conducting path at pump operating temperatures below a predefined temperature whereby heat conduction from the pump housing to the cooling body is interruptible.

2. The pump cooling system as claimed in claim 1, wherein the cooling control mechanism includes a space that, in use, is disposed between the cooling body and the pump housing, the space sized to accommodate a heat conducting body that, in use, is movable relative to at least one of the cooling body and the pump housing to open and close the gap.

3. The pump cooling system as claimed in claim 2, wherein:

the cooling control mechanism further comprises a securing member to secure the cooling body to the pump housing;

the heat conducting body is configured to be fixed in the space between the cooling body and the pump housing so as to permit the relative movement by thermal expansion and contraction;

the heat conducting body and the securing member have respective coefficients of thermal expansion; and the coefficient of thermal expansion of the heat conducting body is greater than the coefficient of thermal expansion of the securing member so that, in use, when the operating temperature is above the predefined temperature the gap in the heat conducting path is closed by expansion of the heat conducting body to permit conduction of heat from the pump housing to said cooling body via the heat conducting path.

4. A The pump cooling system as claimed in claim 3, wherein the cooling control mechanism further comprises at least one resilient biasing member arranged to provide a biasing force to maintain the gap at operating temperatures below the predefined temperature.

5. The pump cooling system as claimed in claim 3, wherein the securing member comprises a first transverse surface configured to engage the cooling body and a second transverse surface configured to engage the pump housing, a distance defined between the first and second transverse surfaces defines a distance between the pump housing and the cooling body, and the heat conducting body has a thickness at temperatures below the predefined temperature that is less than the distance so as to provide the gap.

6. The pump cooling system as claimed in claim 2, wherein the heat conducting body comprises a body of liquid and further comprising an actuator to cause the liquid to move relative to the cooling body and the pump housing.

7. The pump cooling system as claimed in claim 6, wherein the liquid is a magnetic liquid and the actuator comprises at least one magnet.

8. The pump cooling system as claimed in claim 7, wherein the at least one magnet comprises an electromagnet.

9. The pump cooling system as claimed in claim 1, wherein the cooling control mechanism comprises at least one powered actuator operable to move the cooling body relative to the pump housing.

10. The pump cooling system as claimed in claim 9, wherein the at least one powered actuator comprises at least one of:

i) at least one fluid actuated cylinder connected with the cooling body; or ii) at least one electromagnet.

11. The pump cooling system as claimed in claim 9, wherein the at least one powered actuator is operable to move the cooling body in a first direction, the pump cooling system further comprising at least one resilient biasing element to bias the cooling body in a second direction that is opposite to the first direction.

12. The pump cooling system as claimed in claim 1, wherein the cooling control mechanism comprises a pressure chamber to contain a pressurised gas whereby, in use, selective pressurisation of the pressure chamber controls opening and closing of the gap.

13. The pump cooling system as claimed in claim 12, wherein the pressure chamber is configured to be disposed between the cooling body and the pump housing and at least one conduit extends to the pressure chamber via which the pressure chamber can be i) evacuated to cause one of the gap to close and the gap to open and ii) pressurised to cause the other of the gap to close and the gap to open.

14. The pump cooling system as claimed in claim 12, further comprising valving operable, in use, to connect the pressure chamber with at least one of a pressurised gas source and a vacuum source to selectively pressurise the pressure chamber.

15. The pump cooling system as claimed in claim 12, further comprising at least one biasing member to bias the cooling body in a direction to open the gap.

16. The pump cooling system as claimed in claim 6, further comprising a controller and at least one temperature sensor, the controller being configured to provide signals that cause operation of the cooling control mechanism to open and close the gap in response to a determination based on signals provided by the at least one temperature sensor.

17. A pump comprising:

a pump housing and a pumping mechanism disposed in the pump housing; and a pump cooling system comprising a cooling body and a cooling control mechanism, wherein the cooling body is configured to receive heat from the pump housing via a heat conducting path and is provided with a passage through which, in use, a cooling fluid is passed to conduct heat away from the cooling body, and the cooling control mechanism is configured to provide a gap in the heat conducting path between the pump housing and the cooling body at pump operating temperatures below a predefined temperature, whereby heat conduction from the pump housing to the cooling body is interruptible.

18. The pump as claimed in claim 17, wherein the pump is a vacuum pump.

19. A method of providing cooling for a pump comprising:

providing a cooling body to receive heat from the pump by heat conduction, the cooling body having a passage through which cooling fluid is passed to convey heat away from the cooling body;

providing a cooling control mechanism configured to provide a gap in a heat conducting path between the pump and the cooling body when pump operating temperatures are below a predefined temperature whereby heat conduction between the pump and the cooling body is controllably interruptible.

20. The method as claimed in claim 19, wherein providing the cooling control mechanism comprises providing a pressure chamber to contain a pressurised gas whereby, in use, selective pressurisation of said pressure chamber controls opening and closing of the gap.

* * * * *